US009419396B2

(12) United States Patent
Ferran Palau et al.

(10) Patent No.: US 9,419,396 B2
(45) Date of Patent: Aug. 16, 2016

(54) FEMALE FUSE TERMINAL AND PRINTED CIRCUIT BOARD ASSEMBLY THEREFOR

(71) Applicant: Lear Corporation, Southfield, MI (US)

(72) Inventors: Joan Ignasi Ferran Palau, Valls (ES); Antonio Tomas Amenos, Valls (ES); Enric Aparicio Rollan, Valls (ES)

(73) Assignee: Lear Corporation, Southfield, MI (US)

( * ) Notice: Subject to any disclaimer, the term of this patent is extended or adjusted under 35 U.S.C. 154(b) by 110 days.

(21) Appl. No.: 13/906,894

(22) Filed: May 31, 2013

(65) Prior Publication Data

US 2013/0330948 A1 Dec. 12, 2013

Related U.S. Application Data

(60) Provisional application No. 61/657,127, filed on Jun. 8, 2012.

(51) Int. Cl.

| | |
|---|---|
| ***H01R 33/06*** | (2006.01) |
| ***H01R 13/684*** | (2011.01) |
| ***H01H 85/20*** | (2006.01) |
| *H01R 12/71* | (2011.01) |

(52) U.S. Cl.

CPC ..... *H01R 33/06* (2013.01); *H01H 85/2035* (2013.01); *H01R 13/684* (2013.01); *H01H 2085/208* (2013.01); *H01H 2085/2085* (2013.01); *H01R 12/718* (2013.01)

(58) Field of Classification Search

CPC .. H01R 13/6658; H01R 13/514; H01R 31/06; H01R 13/44

USPC ..... 439/76.2

See application file for complete search history.

(56) References Cited

U.S. PATENT DOCUMENTS

| | | | | |
|---|---|---|---|---|
| 4,355,853 | A * | 10/1982 | Kourimsky | H01H 85/20 439/65 |
| 4,703,397 | A * | 10/1987 | Minoura et al. | B60R 16/0239 361/752 |
| 4,909,754 | A * | 3/1990 | Paradis | H01R 4/2429 439/395 |
| 5,259,793 | A | 11/1993 | Yamada et al. | |
| 5,368,503 | A | 11/1994 | Savage, Jr. | |
| 5,662,496 | A | 9/1997 | Kanamori | |
| 5,931,705 | A | 8/1999 | Young | |

(Continued)

FOREIGN PATENT DOCUMENTS

| | | | |
|---|---|---|---|
| CN | 201197042 | Y | 2/2009 |
| CN | 201797106 | U | 4/2011 |

(Continued)

OTHER PUBLICATIONS

German Office Action for corresponding Application No. DE 10 2013 210 628.9, mailed Feb. 7, 2014, 8 pages.

Chinese Office Action for corresponding Application No. 201310227400.1, mailed Feb. 15, 2015, 7 pages.

*Primary Examiner* — Truc Nguyen

(74) *Attorney, Agent, or Firm* — Brooks Kushman P.C.

(57) ABSTRACT

A female fuse terminal is provided with a longitudinally extending blade portion sized to be received within a socket. An intermediate portion extends from the blade portion and extends at an acute angle from a longitudinal direction of the blade portion. A female portion is sized to receive a fuse blade, and extends from the intermediate portion such that the female portion is offset parallel to the blade portion. A printed circuit board assembly is provided with a (PCB) having a socket sized to receive the terminal.

9 Claims, 4 Drawing Sheets

(56) References Cited

U.S. PATENT DOCUMENTS

| | | | | |
|---|---|---|---|---|
| 6,062,916 | A | 5/2000 | Gladd et al. | |
| 6,126,457 | A | 10/2000 | Smith et al. | |
| 6,379,198 | B1 | 4/2002 | Arnett et al. | |
| 6,891,463 | B2 | 5/2005 | Nagaoka | |
| 2003/0133273 | A1* | 7/2003 | Nagaoka | 361/752 |
| 2006/0040527 | A1* | 2/2006 | Shirota | H01R 9/2466 439/76.2 |

FOREIGN PATENT DOCUMENTS

| | | | |
|---|---|---|---|
| DE | 69518157 | T2 | 3/2001 |
| DE | 10045073 | A1 | 9/2002 |
| DE | 102008045810 | A1 | 3/2010 |
| DE | 202010013731 | U1 | 12/2010 |
| DE | 202011102354 | U1 | 9/2011 |
| EP | 1919035 | A1 | 5/2008 |

* cited by examiner

FEMALE FUSE TERMINAL AND PRINTED CIRCUIT BOARD ASSEMBLY THEREFOR

CROSS-REFERENCE TO RELATED APPLICATIONS

This application claims the benefit of U.S. provisional Application No. 61/657,127 filed Jun. 8, 2012, the disclosure of which is incorporated in its entirety by reference herein.

TECHNICAL FIELD

Various embodiments relate to female fuse terminals, and printed circuit board assemblies for female fuse terminals.

BACKGROUND

There is a constant desire to minimize the overall size of electronics to improve compactness of electronics. In the automotive industry, reductions in size result in an increase in aerodynamic efficiency and a reduction in weight, which both consequently, increase fuel efficiency. Such advances include the development of smaller fuses, such as micro fuses.

There are some limits to compactness, however. A minimum distance for a terminal from an edge of a printed circuit board (PCB) is often observed to maintain a desired structural integrity of the PCB and the terminal.

SUMMARY

According to at least one embodiment, a female fuse terminal is provided with a longitudinally extending blade portion sized to be received within a socket. An intermediate portion extends from the blade portion and extends at an acute angle from a longitudinal direction of the blade portion. A female portion is sized to receive a fuse blade, and extends from the intermediate portion such that the female portion is offset parallel to the blade portion.

According to a further embodiment, a printed circuit board assembly is provided with a PCB having a socket sized to receive a terminal. A female fuse terminal is provided with a longitudinally extending blade portion received within the socket. An intermediate portion extends from the blade portion and extends at an acute angle from a longitudinal direction of the blade portion. A female portion is sized to receive a fuse blade, and extends from the intermediate portion such that the female portion is offset parallel to the blade portion.

According to at least one embodiment, a printed circuit board assembly is provided with a PCB having a first socket sized to receive a connector assembly, and a second socket sized to receive a terminal. The second socket is spaced apart from the first socket at least a predetermined distance for a terminal socket to a connector socket. A terminal has a male portion received within the second socket, and a female portion sized to receive a blade, extending from the male portion such that the female portion is spaced apart from the first socket a distance that is less than the predetermined distance for the terminal socket to the connector socket.

According to at least another embodiment, a printed circuit board assembly is provided with a PCB having a first socket sized to receive a connector assembly, and a second socket sized to receive a terminal. The second socket is spaced apart from the first socket at least a predetermined distance for a terminal socket to a connector socket. A terminal has a male portion received within the second socket, an intermediate portion extending from the blade portion and angled from the blade portion, and a female portion sized to receive a fuse blade, extending from the intermediate portion such that the female portion is spaced apart from the first socket a distance that is less than the predetermined distance for the terminal socket to the connector socket. A connector assembly is received within the second socket. A fuse has a first blade received within the connector assembly and a second blade received within the female portion of the female fuse terminal.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
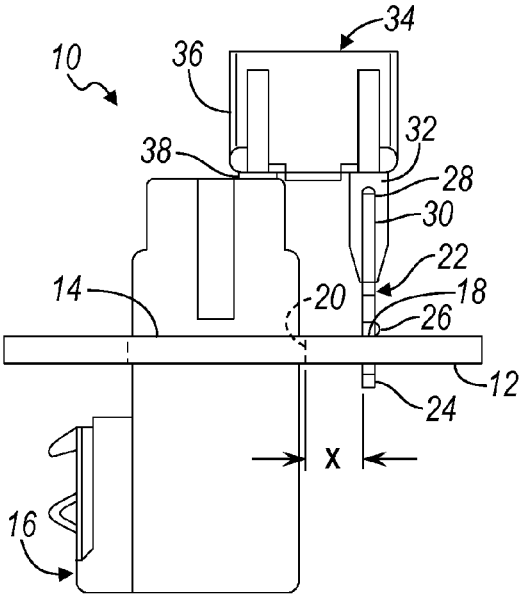
FIG. 1 is a side elevation view of an unclaimed printed circuit board (PCB) assembly illustrated with a first fuse.
Figure 2:
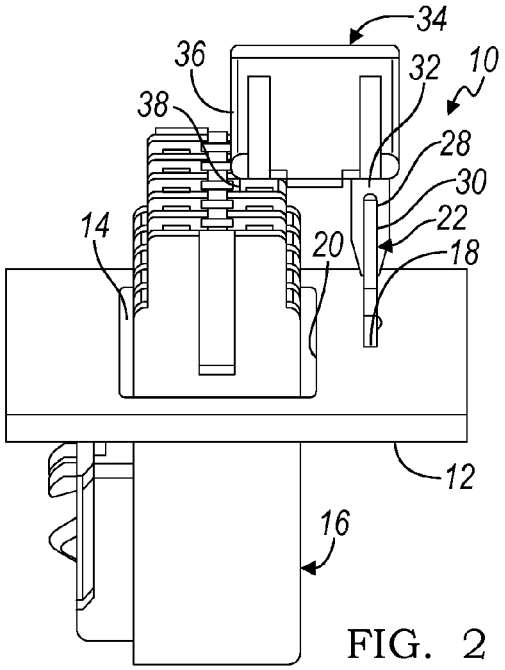
FIG. 2 is a perspective view of the PCB assembly of FIG. 1.

With reference to FIGS. 1 and 2, a printed circuit board assembly 10 is illustrated having a printed circuit board (PCB) 12. The printed circuit board assembly 10 may be employed in a junction box, for example; and may be employed in an automotive junction box. The PCB 12 has a connector socket 14 formed through a thickness of the PCB for receipt of a connector assembly 16. A terminal socket 18 is also formed through the PCB 12. The connector socket 14 forms an edge 20 in the PCB 12. The terminal socket 18 is spaced a dimension X from the edge 20 of the connector socket 14. The dimension X may be a design requirement for the PCB 12, wherein the terminal socket 18 is spaced apart at least X to maintain a structural integrity of the PCB 12 and that of the terminal socket 18 for the particular design.

A female fuse terminal 22 is provided with a flat body including a male blade portion 24 received within the terminal socket 18 for electrical communication with the PCB 12. The female terminal 22 includes a projection 26 which prevents over-insertion of the male blade portion 24 into the PCB 12 and which may be utilized for locating the female terminal 22. The female terminal 22 includes a female portion 28 with a slot 30 that is sized to receive a blade 32 of a fuse 34.

Another blade 36 of the fuse 34 is received within a female terminal 38 in the connector assembly 16.

Figure 3:
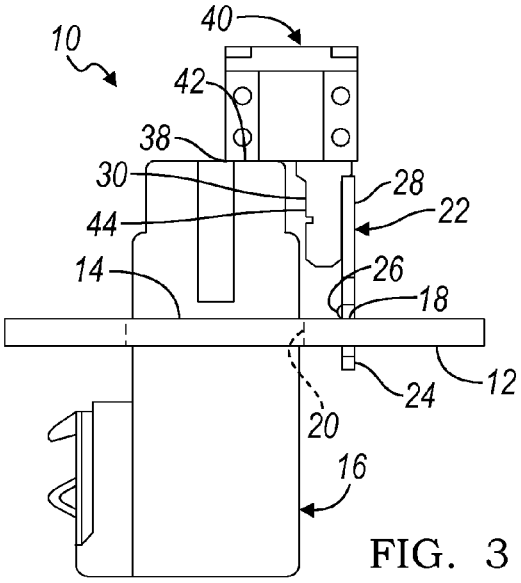
FIG. 3 is a side elevation view of the PCB assembly of FIG. 1 illustrated with a second fuse.

The fuse 34 depicted in FIGS. 1 and 2 is a mini fuse. The spacing of the blades 32, 36 is adequate to traverse the spacing, dimension X, of the edge 20 of the connector socket 14 and the terminal socket 18. In FIG. 3, the PCB assembly 10 is illustrated with the mini fuse 34 removed and replaced with a micro fuse 40. The micro fuse 40 is smaller and more compact than the mini fuse 34; however, the micro fuse 40 includes male blades 42, 44 with a smaller spacing. With one blade 42 within the female terminal 38 of the connector assembly 16, the other blade 44 is not centered in the slot 30 of the female fuse terminal 22. This arrangement results in a poor electrical connection between the blade 44 and the female fuse terminal 22 at a minimum spacing, dimension X, of the edge 20 of the connector socket 14 and the terminal socket 18.

Figure 4:
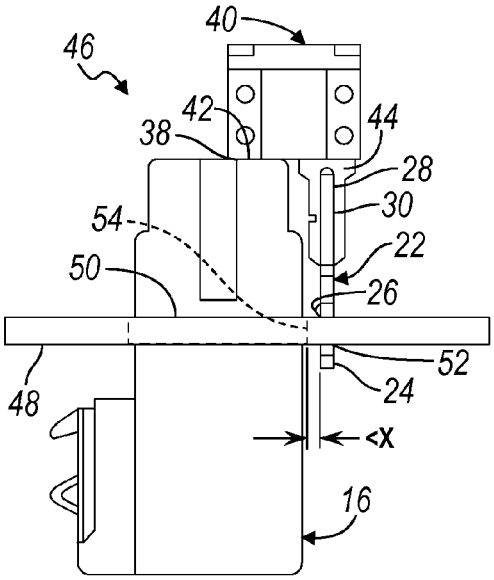
FIG. 4 is a side elevation view of another unclaimed PCB assembly illustrated with the second fuse.
Figure 5:
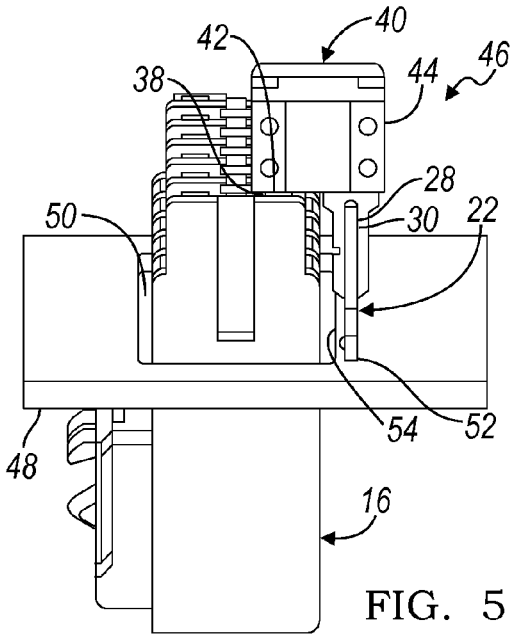
FIG. 5 is a perspective view of the PCB assembly of FIG. 4.

FIGS. 4 and 5 depict a printed circuit board assembly 46 with a PCB 48 similar to the prior examples. The PCB 48 has a connector socket 50 formed through a thickness of the PCB for receipt of the connector assembly 16. A terminal socket 52 is also formed through the PCB 48. The connector socket 50 forms an edge 54 in the PCB 48. The terminal socket 52 is spaced a dimension <X from the edge 54 of the connector socket 50. The dimension <X is less than the dimension X that is recommended as a design requirement for the PCB 48. Therefore, the PCB 48 is not designed to maintain a structural integrity of the PCB 48 and that of the terminal socket 52 for the particular design. The female terminal 22 is received within the terminal socket 52. The design of the PCB 48 risks damage of the connection between the PCB 48 and the female terminal 22.

Figure 6:
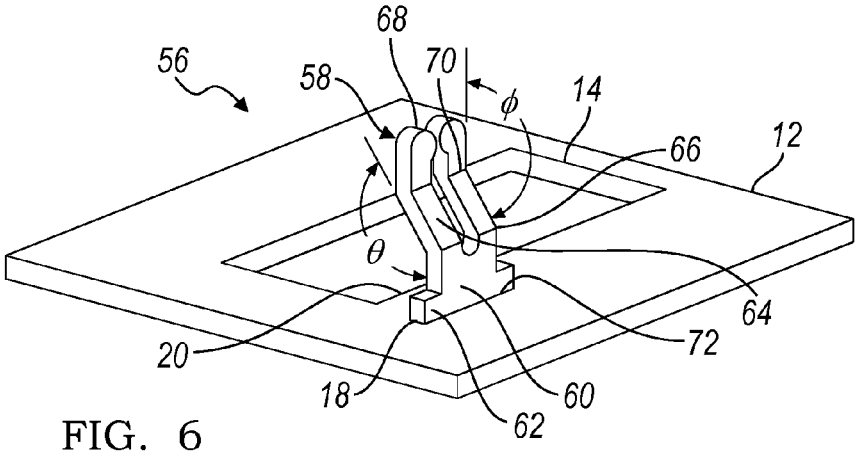
FIG. 6 is a perspective view of a PCB assembly according to an embodiment.
Figure 7:
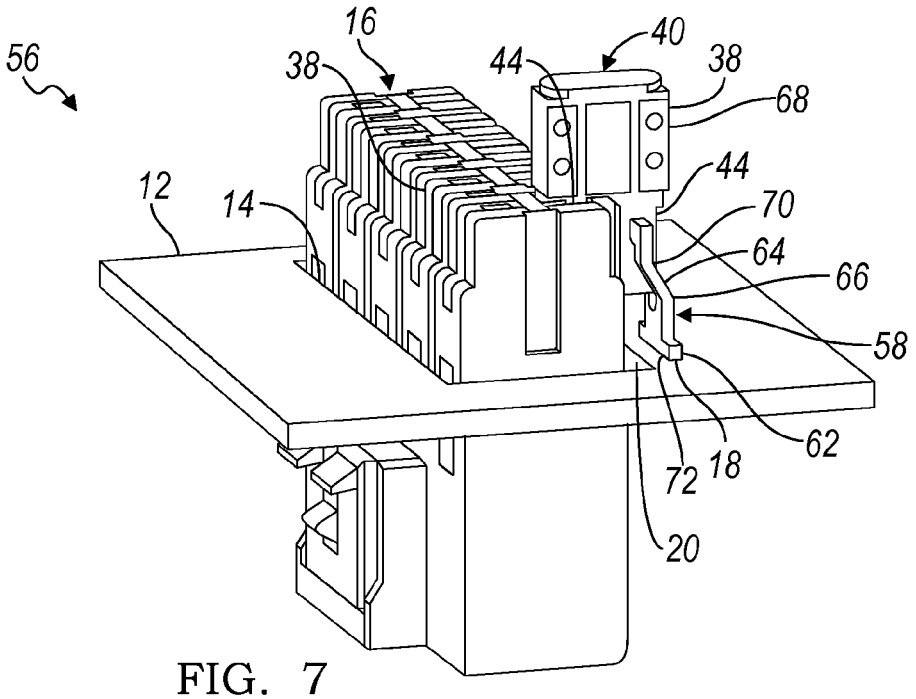
FIG. 7 is a perspective view of the PCB assembly of FIG. 6 illustrated with a connector assembly and the second fuse, according to another embodiment.

With reference to FIGS. 6 and 7, a printed circuit board assembly 56 is illustrated according to an embodiment, utilizing the PCB 12. The printed circuit board assembly 56 may be employed in a junction box, for example; and may be employed in an automotive junction box. As stated before, the PCB 12 has the connector socket 14 formed through a thickness of the PCB for receipt of the connector assembly 16 as illustrated in FIG. 7. The terminal socket 18 is also formed through the PCB 12. The connector socket 14 forms the edge 20 in the PCB 12. The terminal socket 18 is spaced the dimension X from the edge 20 of the connector socket 14, as previously illustrated in FIG. 1.

Figure 9:
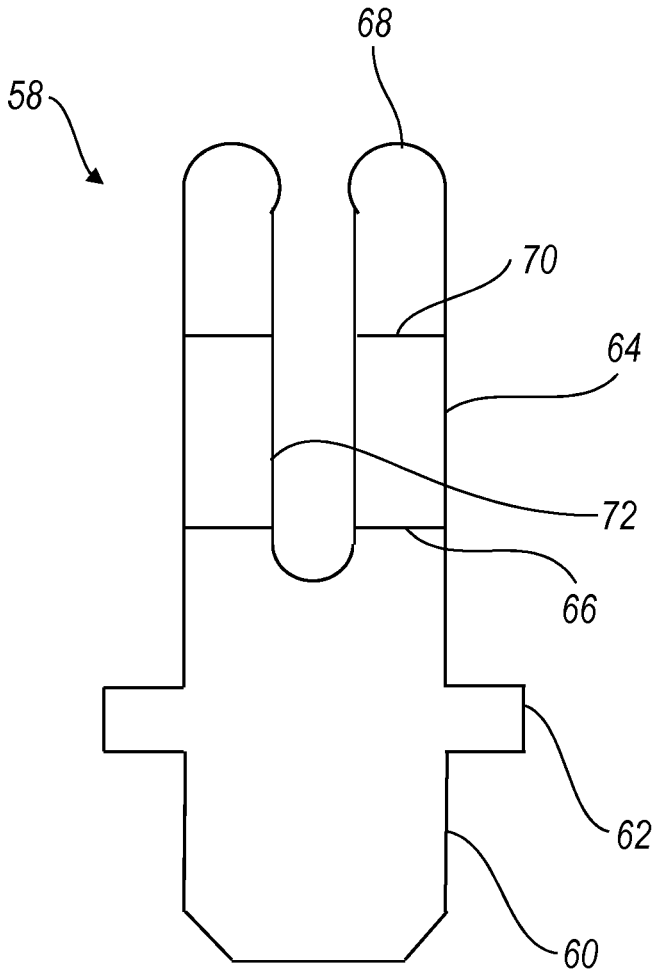
FIG. 9 is a side elevation view of a female fuse terminal of the PCB assembly of FIG. 6.

Referring to FIGS. 6, 7 and 9, a female fuse terminal 58 is provided with a flat body including a longitudinally extending male blade portion 60 received within the terminal socket 18 for electrical communication with the PCB 12. Although one female fuse terminal 58 and one terminal socket 18 are illustrated and described, any number is contemplated within the spirit and scope. The female terminal 58 includes a pair of projections 62 which may be utilized for insertion and pressing of the female terminal 58 into the PCB 12 during manufacturing. The blade portion 60 may be soldered to the PCB 12 to secure the female terminal 58 and to maintain the electrical connection therebetween.

An intermediate portion 64 extends from the blade portion 60 at a first bend 66 and extends at an angle relative to the longitudinal direction. In the depicted embodiment, the intermediate portion 64 forms an obtuse angle Θ relative to the male blade portion 60 to utilize less material as would be required if oriented perpendicular to the male blade portion 60.

The female terminal 58 includes a female portion 68 extending from the intermediate portion 64 at a second bend 70 and extends an obtuse angle Φ to orient the female portion 68 offset parallel to the blade portion 60. The offset of the female portion 68 from the blade portion 60 orients the female portion at a distance <X relative to the edge 20, which is less than dimension X. Angles Θ, Φ may be generally equivalent so that the female portion 68 is parallel with the blade portion 60.

A slot 72 is formed in the female portion 68 of the female fuse terminal 58, which is sized to receive the blade 44 of the micro fuse 40. The slot 72 may extend into the intermediate portion 64 to provide clearance for the blade 44. The slot 72 may have a reduced width in the female portion 68 for maintaining an electrical within this region.

The female terminal 58 permits use of a micro fuse 40 within the structural design constraints of the PCB 12 without a reduction in quality of an electrical connection. Additionally, the female terminal 58 provides modularity wherein one PCB 12 may be utilized in various PCB assemblies 12, 56 that have varying fuse 34, 40 requirements. Moreover, the female terminal 58 permits an upgrade in fuse compactness from the PCB assembly 10 to the PCB assembly 56 without requiring a redesign of the PCB 12. The female terminal 58 may be embodied in various shapes within the spirit and scope of the invention.

Figure 8:
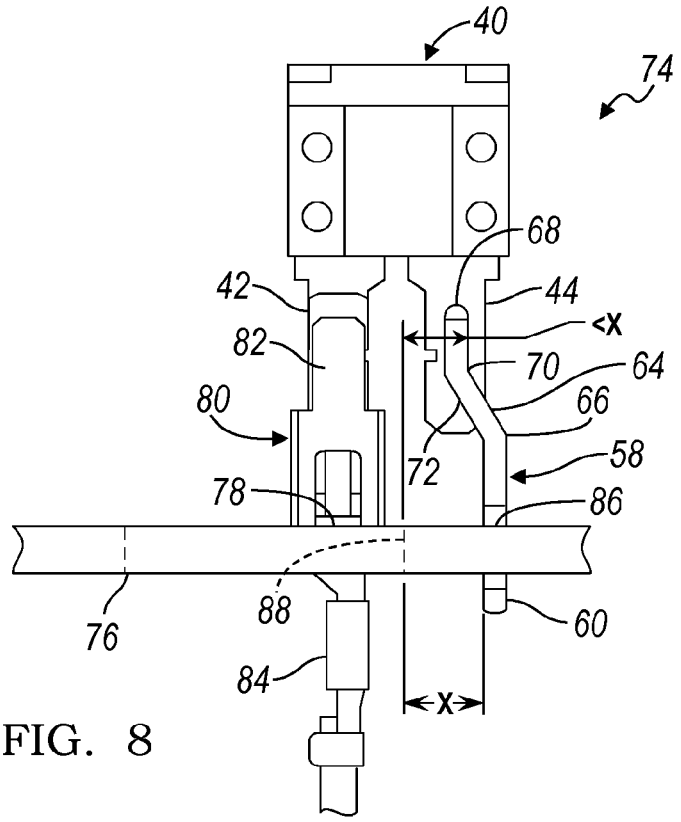
FIG. 8 is a side elevation view of a PCB assembly according to yet another embodiment, illustrated with the second fuse.

FIG. 8, illustrates a PCB assembly 74 with a PCB 76 with a connector socket 78 that receives a connector assembly 80. The depicted connector assembly 80 includes a female terminal 82 and a wire 84 connected to the female terminal 82. The connector assembly 80 may be provided as depicted with the female terminal 82 secured directly in the connector socket 78, or may be provided as a subassembly installed into the connector assembly 16 of prior embodiments. A terminal socket 86 is spaced a dimension X from an edge 88 in the connector socket 78. The female fuse terminal 58 of the prior embodiment is installed into the terminal socket 86. The micro fuse 40 is installed into the female terminals 82, 58 via the blades 42, 44 respectively.

While various embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A printed circuit board assembly comprising:

a printed circuit board (PCB) having at least one socket sized to receive a terminal; and at least one female fuse terminal received in the socket, the at least one female fuse terminal comprising:

only one male blade portion, the only one male blade portion extending longitudinally and being sized to be received within a socket, an intermediate portion extending from the only one male blade portion at an obtuse angle from the only one male blade portion, and a female portion sized to receive a fuse blade, extending from the intermediate portion such that the female portion is offset parallel to the only one male blade portion;

wherein the at least one socket is further defined as a first socket;

wherein the PCB has a second socket sized to receive a connector assembly, the second socket being larger than the first socket and spaced apart from the first socket at least a first distance;

wherein the female portion is spaced apart from the second socket a second distance that is less than the first distance; and wherein the PCB does not include any apertures formed therein within the first distance from the first socket.

2. The PCB assembly of claim 1 wherein the terminal is formed from a flat material with a bend between the only one male blade portion and the female portion.

3. The PCB assembly of claim 2 wherein a slot is provided in the female portion to receive the fuse blade.

4. The PCB assembly of claim 3 wherein the slot extends to the intermediate portion.

5. The PCB assembly of claim 1 wherein the terminal is formed from a flat material with a first bend between the only one male blade portion and the intermediate portion, and a second bend between the intermediate portion and the female portion.

6. The PCB assembly of claim 5 wherein the female portion is parallel with the only one male blade portion.

7. The PCB assembly of claim 1 wherein the only one male blade portion has an increased width to provide a feature for insertion and pressing during installation into the PCB.

8. The PCB assembly of claim 1 further comprising a connector assembly to receive multiple fuse blades, received within the second socket.

9. The PCB assembly of claim 8 further comprising a fuse with a first blade received within the connector assembly and a second blade received within the female portion of the at least one female fuse terminal.

* * * * *